US005427565A

United States Patent [19]

Godichon

[11] Patent Number: 5,427,565

[45] Date of Patent: Jun. 27, 1995

[54] METHOD AND DEVICE FOR CLEANING FAN IMPELLERS

[75] Inventor: Alain Godichon, Saint-Remy, France

[73] Assignee: ABB Flakt AB, Stockholm, Sweden

[21] Appl. No.: 66,164

[22] PCT Filed: Dec. 3, 1991

[86] PCT No.: PCT/SE91/00820

§ 371 Date: Sep. 29, 1993

§ 102(e) Date: Sep. 29, 1993

[87] PCT Pub. No.: WO92/10683

PCT Pub. Date: Jun. 25, 1992

[30] Foreign Application Priority Data

Dec. 7, 1990 [SE] Sweden ..... 9003907

[51] Int. Cl.[6] ..... B24C 5/00

[52] U.S. Cl. ..... 451/75; 451/91; 451/38

[58] Field of Search ..... 451/75, 91, 102, 38, 451/39, 40

[56] References Cited

U.S. PATENT DOCUMENTS 2,807,442 9/1957 Ledgerwood ..... 51/410
2,972,502 2/1961 Jennings et al. ..... 51/410
3,854,997 12/1974 Peck et al. ..... 51/410
4,624,689 11/1986 Volk et al. .
4,680,900 7/1987 Wadephul et al. ..... 51/410
4,699,665 10/1987 Scharton et al. .
5,303,510 4/1994 Calkins ..... 51/317

FOREIGN PATENT DOCUMENTS 1442028 7/1976 United Kingdom .

*Primary Examiner*—Maurina T. Rachuba
*Attorney, Agent, or Firm*—Oblon, Spivak, McClelland, Maier & Neustadt

[57] ABSTRACT

In a method of cleaning fan impellers bursts of solid material are discharged towards the impeller blades or other parts of the impeller, subjected to deposits, by pulses of compressed air, shot from a compressed air cannon. A device for cleaning fan impellers includes at least one compressed air cannon for directing shots in the form of pulses of compressed air towards the impeller blades or other parts of the impeller. The outlet cylinder (280) of the cannon is loaded with a charge of solid material (4) to be discharged towards the impeller blades or said other parts of the impeller, upon shooting a pulse of compressed air.

9 Claims, 2 Drawing Sheets

METHOD AND DEVICE FOR CLEANING FAN IMPELLERS

TECHNICAL FIELD

The present invention relates to a method and a device for cleaning fan impellers, said device comprising at least one compressed air cannon for directing shots in the form of pulses of compressed air towards the impeller blades or other parts of the impeller, subjected to deposits.

BACKGROUND ART

In Swedish Patent Application No. 8902335-2 a method and a device is described for producing a shock wave by means of a compressed air cannon to unstick deposits on fan impeller blades. This technique is applicable to fans used under heavy environment conditions, like in dusty spaces such as in kilns of cement plants where deposits of dust on the impellers can cause severe vibration problems. FIG. 1 shows an example of a device according to this prior art with a compressed air cannon disposed at the fan inlet.

In some applications the hardness of the deposits on the blade surfaces will be so high that the deposits can not be efficiently removed by pulses of compressed air.

DISCLOSURE OF THE INVENTION

The purpose of the present invention is to improve the efficiency of removing such hard deposits from impeller blades or other parts of a fan impeller.

This purpose is obtained by a method according to claim 1 and a device according to claim 6.

According to the invention hard deposits are removed by throwing bursts of solid material towards the impeller blades or other parts of the impeller, subjected to deposits.

According to advantageous embodiments of the method according to the invention the bursts of solid material are thrown periodically or are controlled as a function of the level of vibration of impeller bearings.

According to another advantageous embodiment of the method according to the invention the bursts of solid material are thrown towards diametrically opposite blades of the impeller by means of two compressed air cannons to avoid excessive unbalance due to unsticking of the deposits.

According to still another advantageous embodiment of the method according to the invention the instant of shooting bursts of solid material is controlled as a function of the blade positions of the rotating impeller to provoke unsticking of deposits on the different blades in a selected order to reduce the unbalance created by this removal of deposits.

According to an advantageous embodiment of the device according to the invention the solid material is contained in a cylindrical cartridge, intended to be positioned in the outlet cylinder of the cannon, the ends of the cylindrical cartridge being closed by a material, brittle enough to be broken by the compressed air pulse. Thus the cartridge has to be of sufficient strength to keep the material during transportation, while the ends of the cartridge has to be so brittle that it is broken, when used in the air cannon, by the shot of compressed air from the cannon.

The solid material used is chosen according to the hardness of the deposits and the fans liability to become damaged. The chosen solid material must be of sufficient strength to crush the deposits and at the same time be friable enough to eliminate the risk of damage or wearing of the impeller blades or other parts of the impeller. Thus, according to still another advantageous embodiment of the device according to the invention, the solid material is formed of a coarse-grained material, the size of the grains being preferably between 5 and 50 mm, which coarse-grain material is friable without hard contents, and is preferably formed of gypsum stones.

The solid material can also comprise an explosive which will explode when hitting the impeller blades or other parts of the impeller, subjected to deposits. With such a material a still more efficient cleaning effect can be obtained.

BRIEF DESCRIPTION OF THE DRAWINGS

An exemplifying embodiment of the device according to the invention will now be described more in detail with reference to the enclosed drawings on which

FIG. 1 shows a fan comprising an impeller 10 mounted inside a fan casing or fan scroll 18.

BEST MODE FOR CARRYING OUT THE INVENTION

Figure 1:
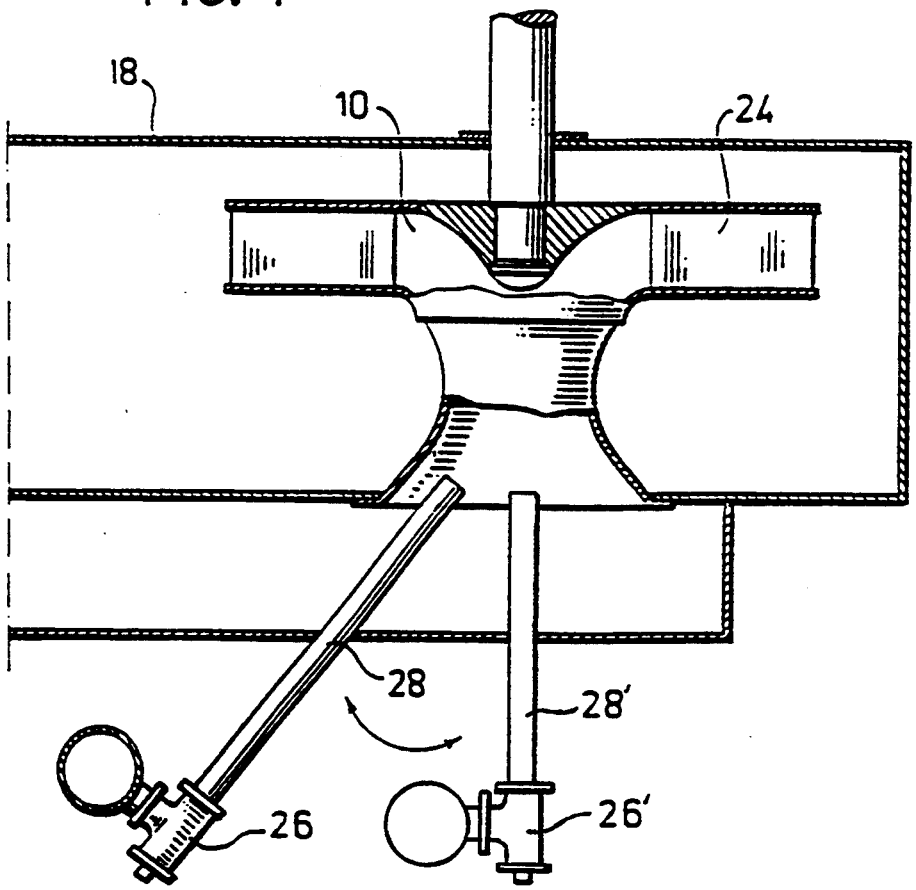
FIG. 1 shows an embodiment of a device of the type used in the present invention with a movable compressed air cannon located at the impeller inlet, FIG. 2 in an axial section a portion of the outlet cylinder of the air cannon charged with a cartridge containing solid material, FIG. 3 a cross-section through the plane 3—3 in FIG. 2, and FIG. 4 a perspective view of the outlet cylinder of the air cannon with the retainer cylinder for the cartridge partly swung out.

A compressed air cannon 26 is located at the impeller inlet. The outlet cylinder 28 of the cannon 26 can be oriented in the axial direction of the fan or in any inclined direction to deliver compressed air pulses towards the impeller blades 24. The compressed air cannon which can be of the type described in the Swedish Patent Application 8902335-2 is shown in FIG. 1 in two different orientations.

Figure 4:
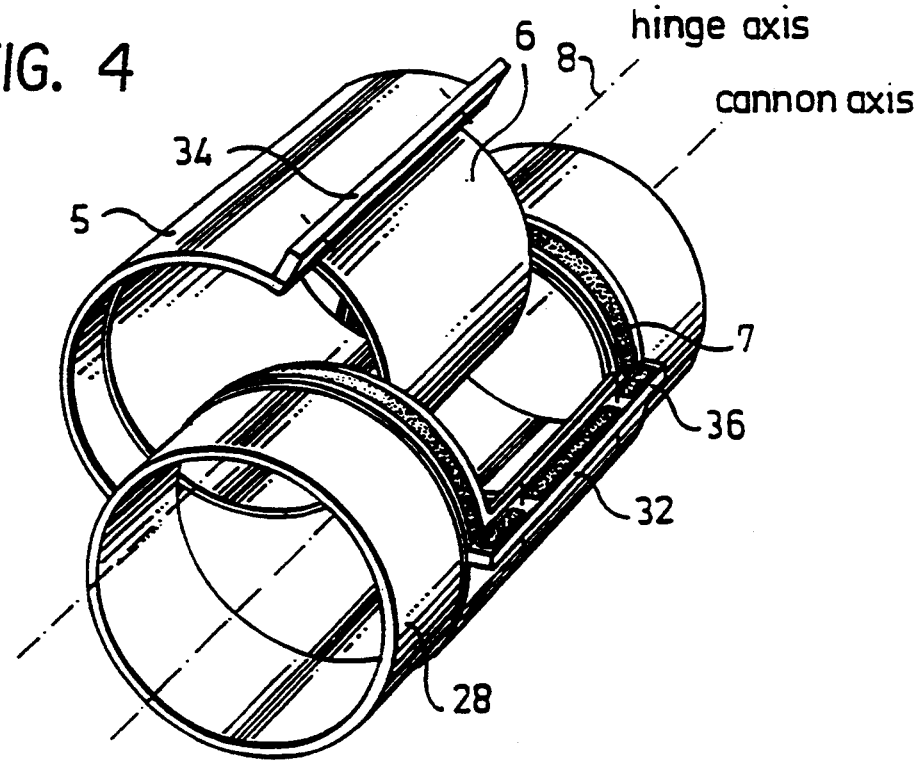
Figure 2:
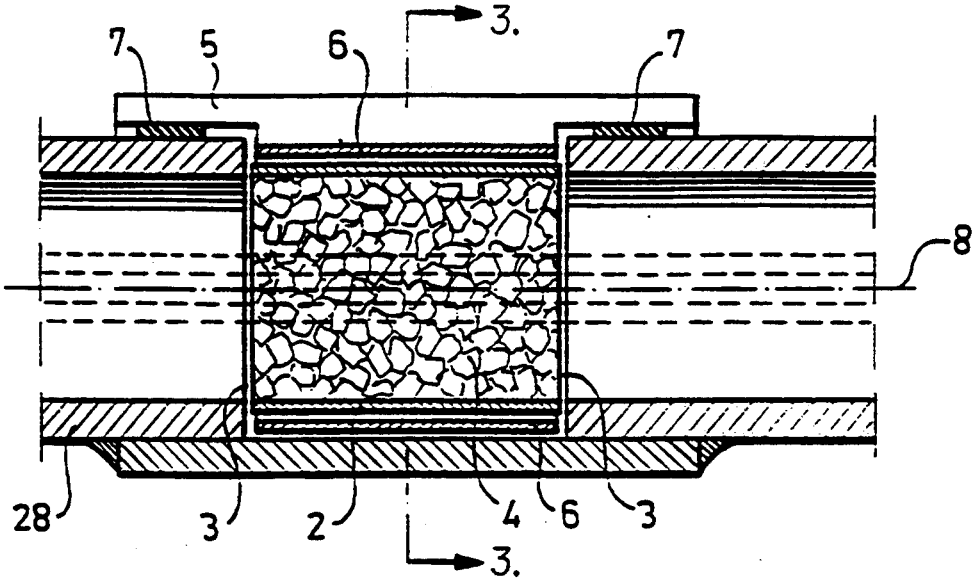
Figure 3:
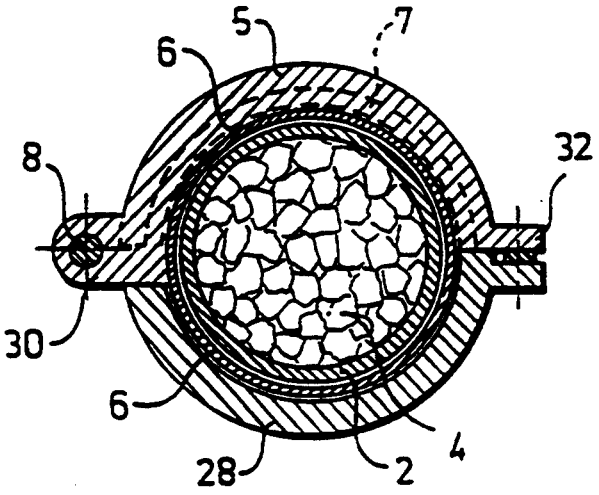

A portion of the outlet cylinder 28 is shown in FIG. 2–4. A cartridge 2 containing solid material 4 is placed in the bore of the outlet cylinder 28.

The cartridge 2 is formed of a material of sufficient strength to keep the material during transportation from being damaged. The ends of the cylinder are closed by a material 3 which is broken by the pressure pulse from the air cannon 26, such that the material 4 is thrown through the outlet cylinder 28 to hit the impeller blades 24 or possibly other parts of the impeller subjected to deposits. The end walls 3 of the cartridge 2 can be formed e.g. of an expanded polystyrene composite or formed as cover plates of a thickness of up to 2 cm which plates are stuck with a proper adhesive to the cartridge cylinder. As another exemple the end walls 3 could be formed of paper of suitable quality.

The outlet cylinder 28 comprises a removable portion 5 in the form of a half cylinder in which a retainer cylinder 6 for the cartridge 2 is mounted. The half cylinder 5 is articuledly mounted by a hinge 30 to the remaining part of the outlet cylinder 28, such that the half cylinder 5 can be swung along the hinge axis 8 out of the bore of the outlet cylinder 28. In this way the retainer cylinder 6 mounted in the half cylinder 5 can be removed from the bore of the outlet cylinder to allow removal of used cartridges 2 and insertion of new ones containing the solid material 4, whereupon the new cartridge 2 is swung into the bore of the outlet cylinder 28.

As a closing device for the movable half cylinder 5, a suitable clamping device 32 is used. A seal 7 is disposed between flanges 34 and 36 formed on the half cylinder 5 and the outlet cylinder 28 respectively to avoid air leakage with the half cylinder 5 positioned in the bore of the outlet cylinder 28.

Other embodiments are possible for introducing the cartridges containing the solid material into the bore of the outlet cylinder. Thus e.g. a construction with guide bars can be used to allow removal of the removable portion from the outlet cylinder by a translational motion, or a revolver system can be associated with the outlet cylinder to allow loading of several cartridges.

The opening of the outlet cylinder to remove used cartridges and inserting new ones is not dangerous for the operator, even if the fan is operating with hot gases. For such applications the fan is operating at a pressure below atmospheric pressure, and therefore when opening the outlet cylinder air is flowing from the atmosphere into the fan. As a consequence, the removable part of the outlet cylinder is then cleaned from dust and cooled rapidly.

The solid material 4 is a rather friable, coarse-grained material with a typical grain size of 5 to 50 mm. The material is selected depending on the application such that deposits are effectively crushed and then blown away as a powder while the material is friable enough for eliminating any risk of damage or wear of the impeller blades. As an exemple gypsum stones can be used without any hard content that could give rise to wear.

The solid material can also be formed of an explosive which will explode when hitting the impeller blades or other parts of the impeller subjected to deposits.

I claim:

1. A device for cleaning fan impellers (10) having blades, comprising:

at least one compressed air cannon (26) having an air cylinder directing shots in the form of pulses of compressed air towards one of the impeller blades (24) and other parts of the impeller, subjected to deposits, a charge of said solid material (4) which is loaded in the outlet cylinder and discharged from said outlet cylinder towards said one of the impeller blades (24) and said other parts of the impeller subjected to deposits, a cylinder cartridge (2) located in said outlet cylinder (28) wherein upon shooting a pulse of compressed air through said outlet cylinder, the solid material (4) is contained in said cylindrical cartridge (2) and wherein ends of the cylindrical cartridge are at least partially enclosed by a material (3) brittle enough to be broken by the compressed air pulse.

2. The device according to claim 1, wherein the material (3) which at least partially encloses the ends of the cylindrical cartridge comprises an expanded polystyrene composite.

3. A device for cleaning fan impellers (10), comprising:

at least one compressed air cannon (26) having an air cylinder directing shots in the form of pulses of compressed air towards one of the impeller blades (24) and other parts of the impeller, subjected to deposits, a charge of solid material which is loaded in the outlet cylinder and discharged from said outlet cylinder towards the impeller blades (24) and said other parts of the impeller subjected to deposits, a cylinder cartridge (2) located in said outlet cylinders (28) wherein upon shooting a pulse of compressed air through said outlet cylinder, the solid material (4) is contained in said cylindrical cartridge (2) and wherein the ends of the cylindrical cartridge (2) are covered by plates which are connected to the cylindrical cartridge.

4. The device according to claims 1 or 2, wherein the outlet cylinder (28) of the air cannon (26) comprises a removable portion (5) allowing insertion of the cartridge (2) containing the solid material (4) into the outlet cylinder of the air cannon.

5. The device according to claim 4, which comprises a hinge wherein the removable portion (5) of the outlet cylinder (28) is mounted to the remaining part of the outlet cylinder by said hinge (30) allowing said removable portion to be swung out of the bore of the outlet cylinder along an axis (8) parallel to the axis of the outlet cylinder.

6. The device according to claims 1 or 2, wherein the solid material (4) is formed of a coarse-grained material, and wherein the grains are of a size between 5 and 50 mm.

7. The device according to claim 6, wherein the coarse-grained material comprises a friable material without hard contents.

8. The device according to claims 1 or 2, wherein the solid material (4) comprises an explosive which explodes upon hitting said one of the impeller blades (24) and other parts of the impeller (10).

9. The device according to claim 7, wherein said friable material comprises gypsum stones.

* * * * *